US007258550B2

(12) United States Patent
Chen et al.

(10) Patent No.: US 7,258,550 B2
(45) Date of Patent: Aug. 21, 2007

(54) ELECTRICAL CONNECTOR ASSEMBLY

(75) Inventors: Chao Chen, Waterloo (CA); John A. Holmes, Waterloo (CA)

(73) Assignee: Research In Motion Limited, Waterloo (CA)

( * ) Notice: Subject to any disclaimer, the term of this patent is extended or adjusted under 35 U.S.C. 154(b) by 0 days.

(21) Appl. No.: 11/074,556

(22) Filed: Mar. 8, 2005

(65) Prior Publication Data

US 2005/0148238 A1 Jul. 7, 2005

Related U.S. Application Data

(63) Continuation of application No. 10/411,442, filed on Apr. 10, 2003, now Pat. No. 6,969,263.

(51) Int. Cl.
*H01R 12/00* (2006.01)

(52) U.S. Cl. ..... 439/66

(58) Field of Classification Search ..... 439/66, 439/591, 862, 856, 633, 680
See application file for complete search history.

(56) References Cited

U.S. PATENT DOCUMENTS 4,395,084 A * 7/1983 Conrad ..... 439/331
5,069,627 A * 12/1991 Buck et al. ..... 439/66
5,484,295 A 1/1996 Mowry et al.
5,991,165 A 11/1999 Jones, Jr. et al.
6,299,457 B1 10/2001 Snyder
6,345,987 B1 * 2/2002 Mori et al. ..... 439/66
6,375,474 B1 * 4/2002 Harper et al. ..... 439/66
6,420,661 B1 * 7/2002 Di Stefano et al. ..... 439/66
6,616,485 B2 * 9/2003 Harasawa et al. ..... 439/862

* cited by examiner

*Primary Examiner*—Felix O. Figueroa
(74) *Attorney, Agent, or Firm*—Jones Day; Krishna K. Pathiyal; Robert C. Liang

(57) ABSTRACT

An electrical connector assembly is provided for connecting at least one electrical contact pad on a first structure with at least one electrical contact pad on an opposing second structure. The connector assembly has a body and electrical connectors extending from the body, and is mountable relative to the first and second structures such that the electrical connectors engage electrical contact pads on the first and second structures. The electrical connectors are of a springy metal and are configured to be suitably biased against the contact pads when the connector assembly is assembled with the first and second structures, so as to provide a contact biasing force preferably in the range of 0.7 N±0.2 N.

10 Claims, 10 Drawing Sheets

ELECTRICAL CONNECTOR ASSEMBLY

CROSS REFERENCE TO RELATED APPLICATION

This application is a continuation of U.S. patent application Ser. No. 10/411,442, filed Apr. 10, 2003 now U.S. Pat. No. 6,969,263, the disclosure of which is incorporated herein by reference in its entirety.

FIELD

This disclosure relates generally to electrical connectors, particularly for use in microelectronic devices. More particularly, this disclosure relates to connectors for connecting electrical contact pads on opposing structures in such devices.

BACKGROUND

Electrical connection between electrical contact pads on independent structures, such as between two printed circuit boards (PCBs), is presently achieved through several methods. Most methods require soldering. Any hand soldering must be done with great care with microelectronics, as minute electrical traces can be damaged easily and microelectronic parts may be dislodged or may be damaged by the heat of a soldering iron.

An example of such a connection is a connection between an electroluminescent (EL) backlight panel and a PCB, in a mobile handheld device, for example. An EL backlight panel is connected to a PCB that has circuitry to drive the EL panel. For connecting an EL backlight panel on a liquid crystal display (LCD) module to a PCB, hand soldering the pads of the EL panel directly to the PCB is undesirable since the phosphor layer used in an EL is extremely sensitive to humidity and temperature changes and the EL panel is thus easily damaged by heat and moisture. The laminate used to hold an EL panel together is also sensitive to humidity and heat. Often delamination occurs when an EL panel is exposed to extreme changes in heat and humidity. In small electronic devices, hand soldering is also difficult to achieve because of the limited amount of space that is usually allowed between the LCD module and the PCB.

Another method of connecting the contact pads of an EL backlight panel to a PCB is to solder a wire from a contact pad of the panel to the corresponding contact pad of the PCB. This type of connection is untidy and occupies valuable room in small electronic devices.

Flex connection is also used as a connection means between an EL backlight panel and a PCB. "Flex" is difficult to work with in assembly since it can be damaged easily when handled. A fold or tear in the flex breaks the electrical connection between the EL panel and the circuitry on the PCB rendering the EL panel inoperative.

Through-slot in a PCB is another connection method between an EL backlight panel and a PCB. The through-slot method requires a hole drilled through the PCB. The hole is plated. The connection for the EL panel in this case is in the form of tabs or pins extending out from the panel rather than pads on the panel. The tabs are placed in the slot and screwed or clamped into the slot. Using an EL backlight panel that has tabs to connect to the EL drive circuitry requires more real estate within an electronic device. As electronic devices miniaturize, space savings within the device become essential.

Both flex connection and through-slot methods require soldering and do not allow for movement between the two boards. When enclosed within an electronic device, accommodating some movement between the PCBs is necessary especially when considering shear forces on the device in the event that it is dropped.

There is, therefore, a need for an improved means of making connections between EL panel contact pads and PCB contact pads that does not require soldering. There is also a need for a connector that requires minimal space to fit between an EL panel on an LCD module and the PCB that are used in a small electronic device.

SUMMARY

In accordance with an embodiment of the example electrical connector, an electrical connector assembly for connecting at least one electrical contact pad on a first structure with at least one electrical contact pad on an opposing second structure comprises a body having electrical connectors extending therefrom, said body being mountable relative to said first and second structures for said electrical connectors to engage electrical contact pads on said first and second structures, said electrical connectors being of a springy metal and configured to be biased against said contact pads when said connector assembly is assembled with said first and second structures.

According to another embodiment, a product assembly for connecting electrical contact pads on opposing first and second structures comprises a frame having means for engaging and aligning said first structure on a first side of said frame and means for engaging and aligning said second structure on a second side of said frame, and an electrical connector assembly mounted within said frame, for connecting at least one electrical contact pad on said first structure with at least one electrical contact pad on said second structure, said connector assembly comprising a body having electrical connectors extending therefrom, said body being mountable relative to said first and second structures for said electrical connectors to engage electrical contact pads on said first and second structures, said electrical connectors being of a springy metal and configured to be biased against said contact pads when said connector assembly is assembled with said first and second structures.

A mobile electronic device in accordance with another embodiment comprises a first and second structure, and an electrical connector assembly to connect at least one electrical contact pad on said first structure with at least one electrical contact pad on said second structure, said electrical connector assembly comprising a body having electrical connectors extending therefrom, said body being mountable relative to said first and second structures for said electrical connectors to engage electrical contact pads on said first and second structures, said electrical connectors being of a springy metal and configured to be biased against said contact pads when said connector assembly is assembled with said first and second structures.

According to a further aspect, a mobile electronic device has an EL panel with at least one electrical contact pad thereon adjacent an edge thereof, said EL panel having a tab portion adjacent at least one said electrical contact pad, said tab portion extending outwardly from said edge by a distance d, where said distance d is sufficient to permit placement of said electrical contact pad with an outer edge thereof generally aligned with said edge of said EL panel beyond said tab portion.

Other aspects and features will become apparent upon review of the following description of specific embodiments in conjunction with the accompanying figures.

BRIEF DESCRIPTION OF THE DRAWINGS

Embodiments will now be described, by way of example only, with reference to the attached Figures, wherein.

DETAILED DESCRIPTION

Figure 1:
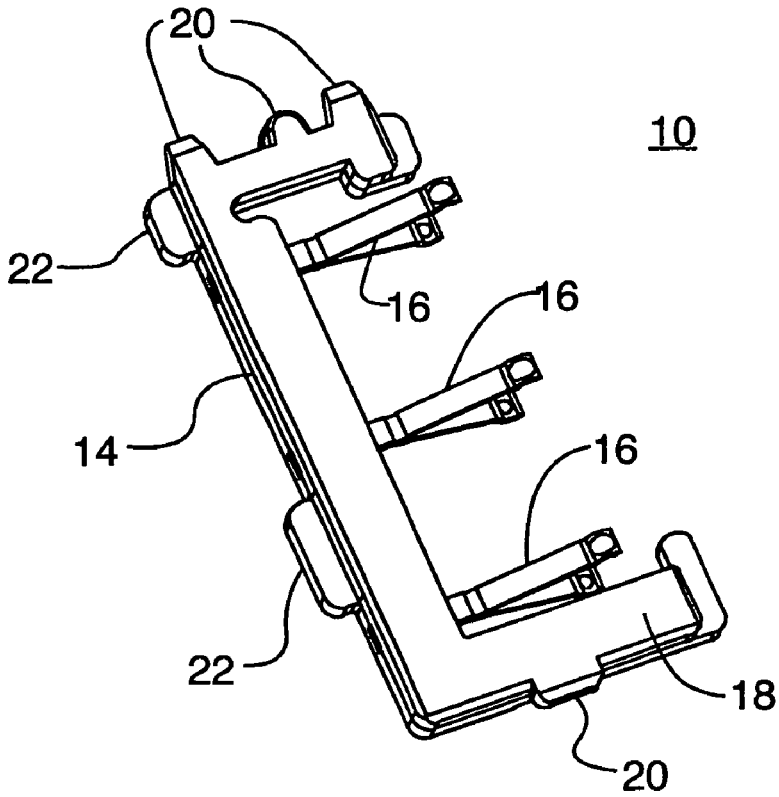
FIG. 1 is an isometric view of an electrical connector assembly.

FIG. 1 is an isometric view of a preferred embodiment of an example electrical connector assembly 10. The connector assembly has a body 14 and electrical connectors 16 extending therefrom to connect electrical contact pads on a first structure with electrical contact pads on a second structure, as described below The body 14 of the connector assembly is a plastic, injection over-molded around portions 33 (FIGS. 4 and 5) of the electrical connectors 16. The electrical connectors 16 are a conductive spring material such as phosphor bronze with gold plating, or an equivalent.

Figure 6:
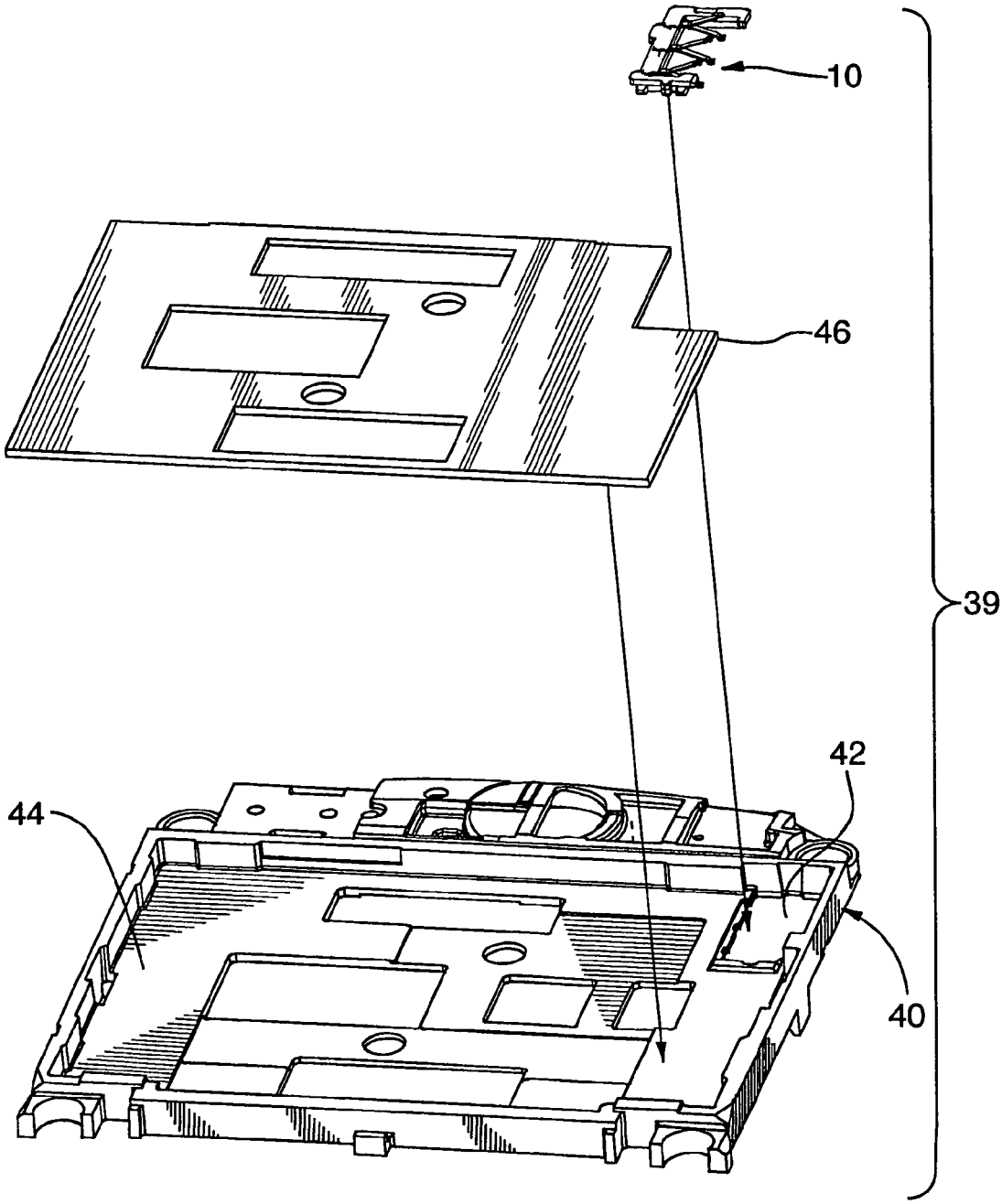
FIG. 6 is a view of an exemplary frame in which the connector assembly may be mounted.
Figure 9:
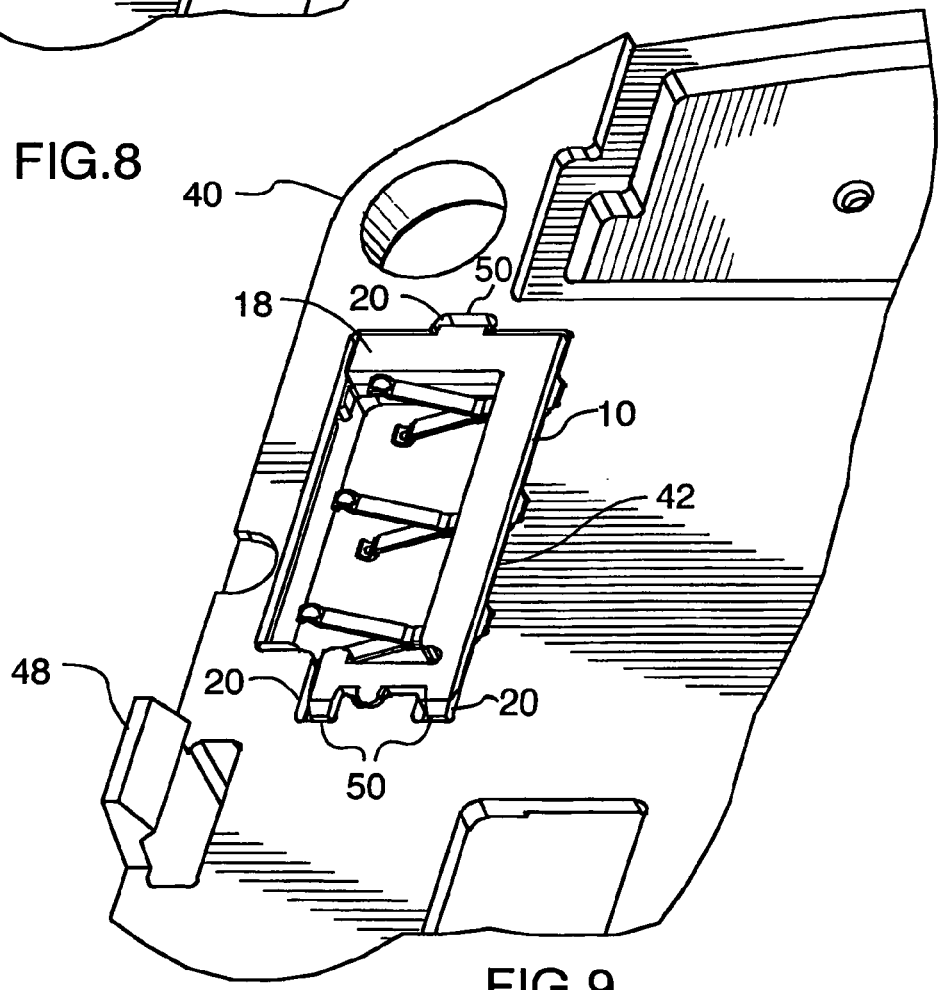
FIG. 9 is a detailed drawing of the front of the frame with the electrical connector assembly mounted within the frame.
Figure 10:
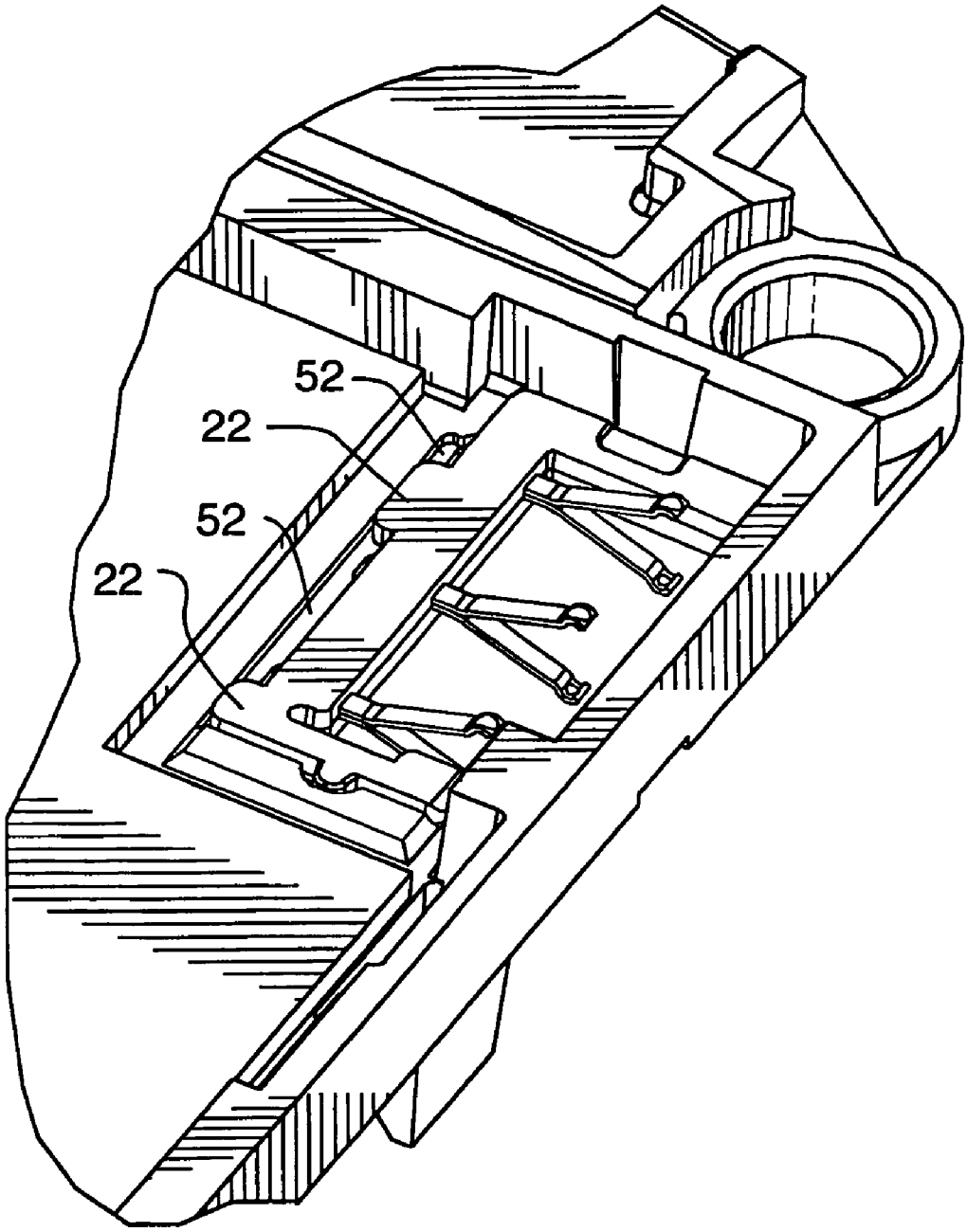
FIG. 10 is a detailed drawing of the back of the frame with the electrical connector assembly mounted within the frame.

The body 14 of the connector assembly 10 is mountable between the first and second structure. In a preferred embodiment, the body 14 fits within a frame 40 and is removable from the frame, as shown in FIG. 6. A release point 18 on the body 14, as shown in FIG. 9, allows for removal of the connector assembly from the frame when pressure is applied to the release point 18. The body 14 has a plurality of protrusions 20, 22, to aid in supporting and locking the body within the frame. That is, the connector assembly 10 is snapped into a frame and held and locked in position by the protrusions 20 and 22 on the body 14 of the connector assembly.

Figure 2:
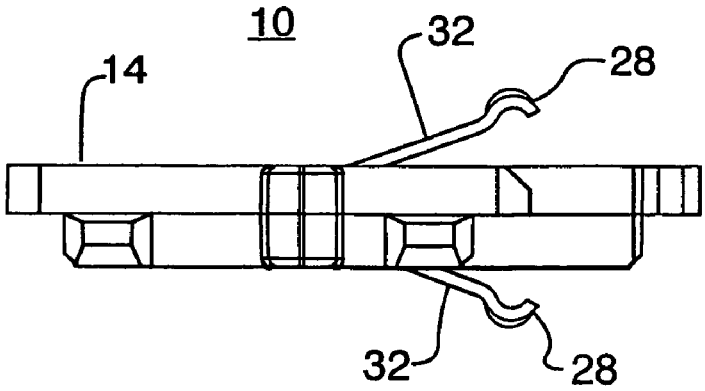
FIG. 2 is a side view of the electrical connector assembly.

FIG. 2 is a side view of the connector assembly. Each electrical connector 16 has two contact arms 32 that extend outwardly from the connector assembly 10. Each contact arm 32 ends in a contact area 28 that engages the contact pads of the first and second structure.

Figure 3:
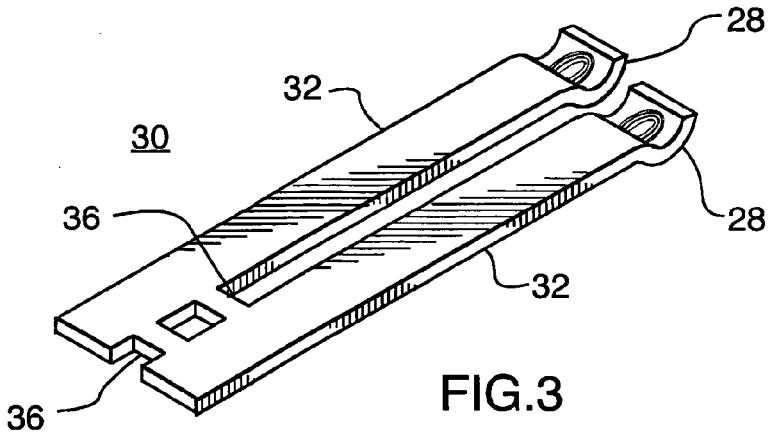
FIG. 3 is an isometric view of a pre-manufactured connector.
Figure 4:
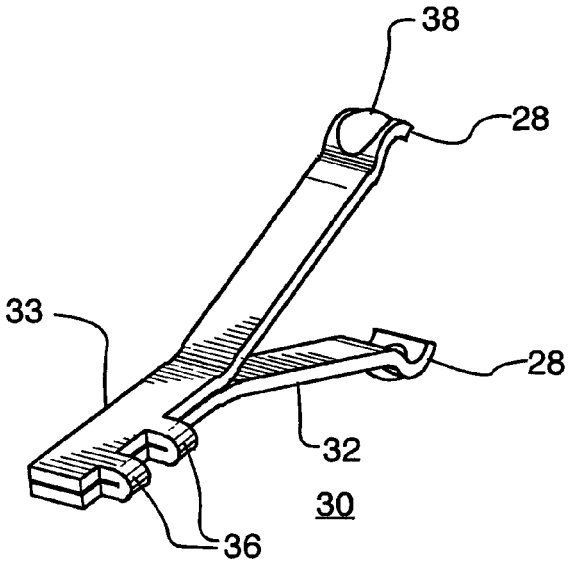
FIG. 4 is an isometric view of a connector.
Figure 5:
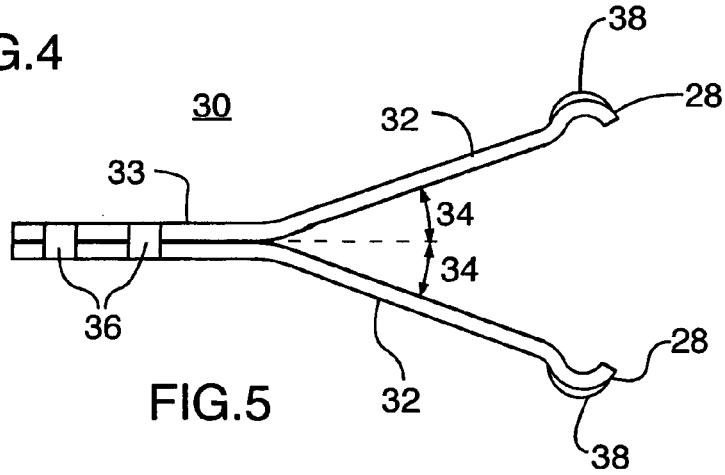
FIG. 5 is a side view of a connector.

FIG. 3 is a view of an unformed electrical connector. The connector is a single stamped metal piece 30. The metal is formed into two contact arms 32 having a common portion 33 (FIGS. 4 and 5). FIG. 4 is an isometric view of the completed electrical contact. FIG. 5 is a side view of the completed electrical contact. To form the contact, the contact arms 32 are bent at an angle 34 relative to the common portion 33. The amount of bending depends on the biasing force desired for biasing the contacts against the contact pads. In an exemplary embodiment, for example, the angle 34 is 19.8 degrees, to provide compression of 0.7 mm on each contact arm when in contact with the contact pads, intended to provide a biasing force preferably in the range of 0.7N±0.2N. The stamped metal 30 has hinging strips 36 between the two arms that connect the two arms 32. The hinging strips 36 are essentially connectors between the two arms. The two arms 32 are folded over 180 degrees at the hinging strips 36 to form the connector so that the two arms 32 diverge from each other at the bend in the arms. Thus, the hinging strips 36 are folded over portions of the stamped metal piece 30 when the connector is in an assembled state. The bend in the arms forms a spring when the arms 32 are folded over. Each arm 32 ends in a contact area 28, which is rounded to increase the surface area where the contact area engages a contact pad. The rounded contact area 28 may have a protuberance 38 to augment the connection between the contact pad and the contact area 28. The body 14 of the connector assembly 10 is overmolded over the common portion 33 of the connector 30.

Figure 7:
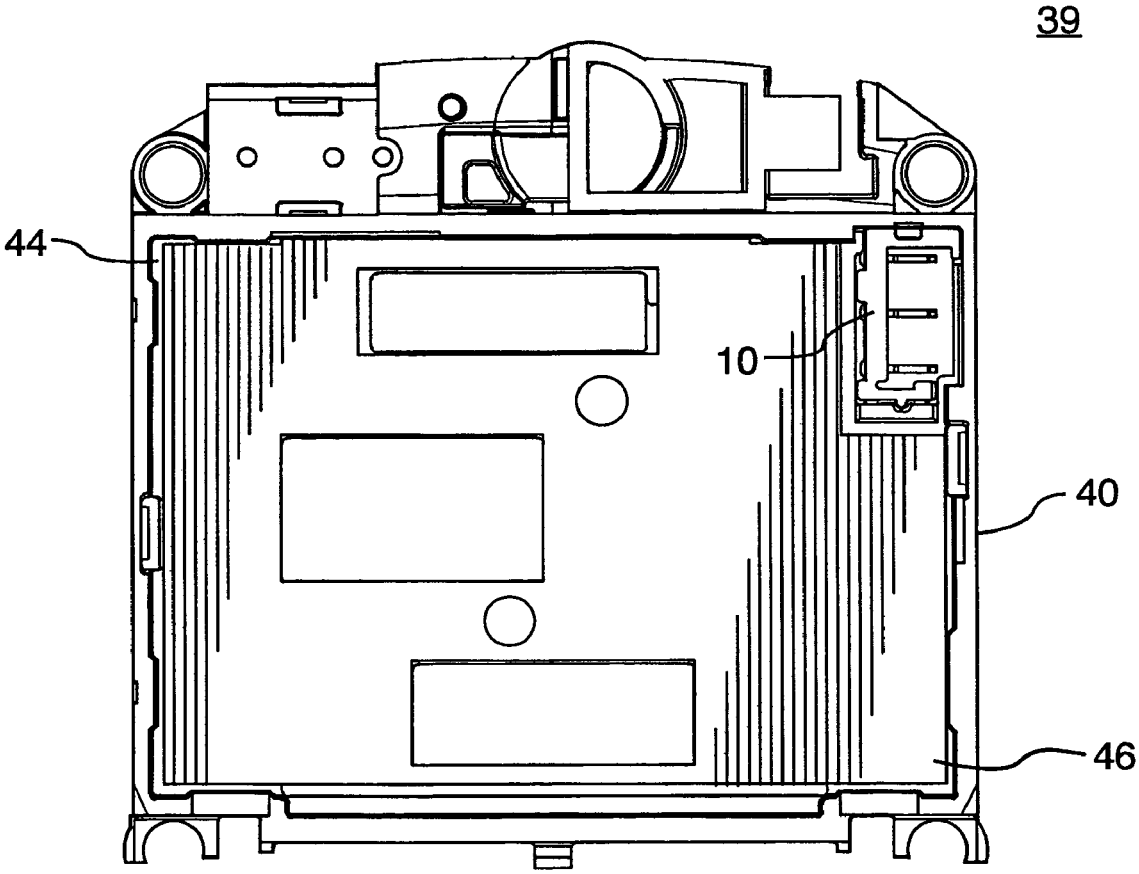
FIG. 7 is a front view of the exemplary frame with the connector assembly mounted therein.
Figure 12:
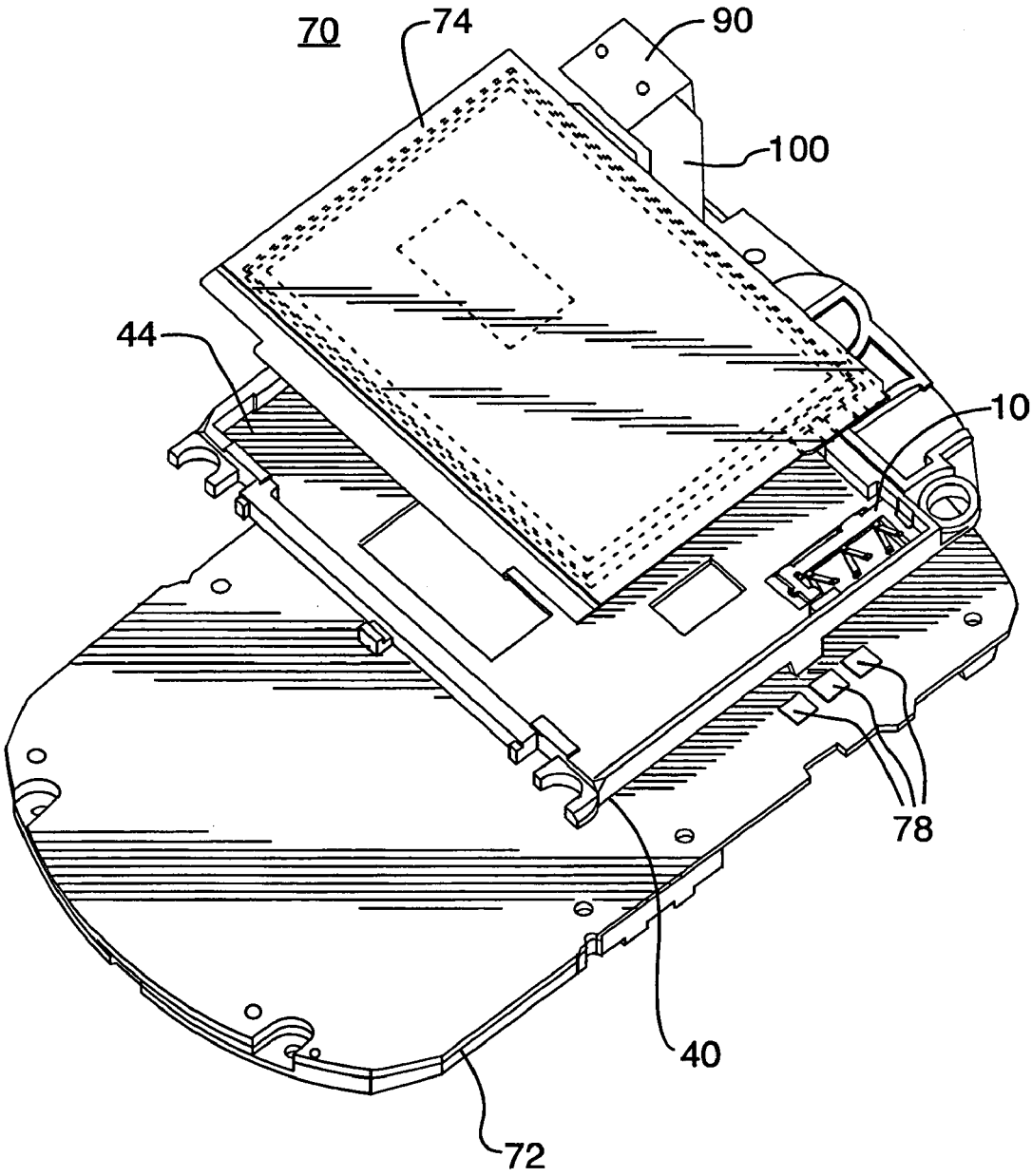
FIG. 12 is an exploded view of an exemplary assembly using the frame with the mounted connector assembly.
Figure 15:
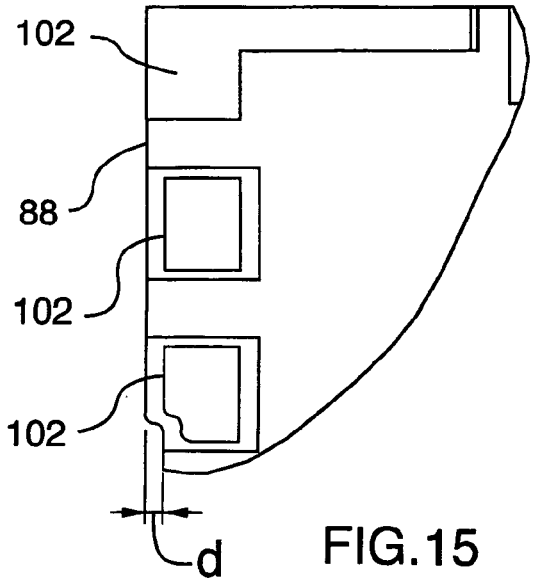
FIG. 15 is a detailed drawing of the contact pads of an EL panel.

FIG. 6 is an exploded view of an exemplary product or frame assembly 39. Such an assembly may be used in electronic devices to connect contact pads on opposing PCBs. The connector assembly 10 is mounted within an opening 42 in a frame 40. The frame 40 has a means for alignment for aligning the first structure, in this particular embodiment an LCD module 74 (FIG. 12). The LCD module has an EL panel 80 (FIG. 13) attached to its underside, having contact pads 102 (FIG. 15). In this example, the alignment means is a recess 44 for holding and aligning a first structure to the frame 40 and thereby to the connector assembly 10. The frame 40 preferably has cushioning 46 that fits within the recess to cushion the first structure in the frame assembly 39 from damage when a device is dropped or shaken. FIG. 7 is a top view of the exemplary frame assembly 39 with the connector assembly 10 mounted therein.

Figure 8:
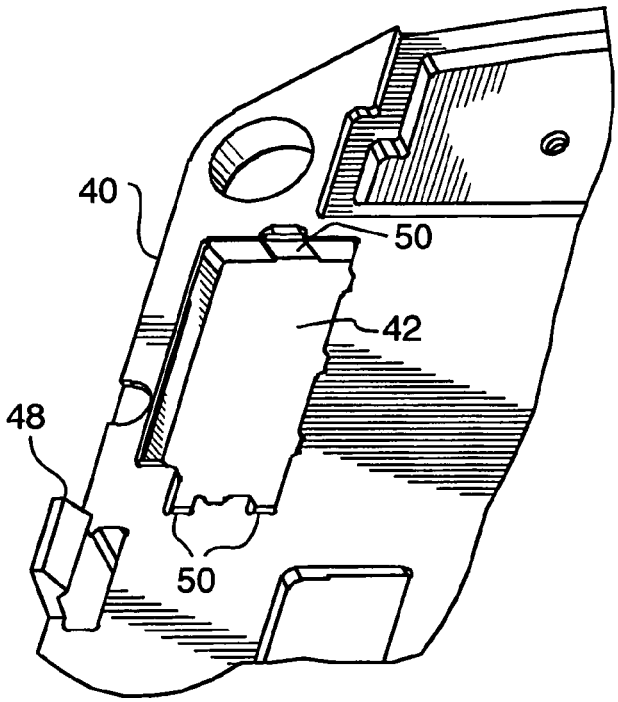
FIG. 8 is a detailed drawing of an opening for the connector assembly in the frame.

FIG. 8 is a detailed drawing of the opening 42 on the bottom side of the frame 40. A plurality of protuberances 20, on the body 14 matches notches 50 within the opening 42 of the frame 40. The bottom side of the frame is supported by a second structure. Alternatively, the bottom of the frame may also have a recess for accommodating and aligning the second structure. In a further alternative embodiment, the bottom of the frame 40 may have an alignment means for aligning the second structure. In the example in FIG. 8, the alignment means for the second structure is a plurality of clamps 48 to align the second structure to the frame 40 and thereby align the second structure to the connector assembly 10.

FIG. 8 is a detailed drawing of the opening 42 on the bottom side of the frame 40. A plurality of protuberances 20, on the body 14 matches notches 50 within the opening 42 of the frame 40. The bottom side of the frame is supported by a second structure. Alternatively, the bottom of the frame may also have a recess for accommodating and aligning the second structure. In a further alternative embodiment, the bottom of the frame 40 may have an alignment means for aligning the second structure. In the example in FIG. 8, the alignment means for the second structure is a plurality of clamps 48 to align the second structure to the frame 40 and thereby align the second structure to the connector assembly 10. Thus, some of the protrusions 20 rest in recesses defined in the top of the frame 40 and some of the protrusions 20 rest in recesses defined in the bottom of the frame 40. The body 14 is resilient in order to allow the connector assembly to be snap inserted into the frame 40.

Figure 11:
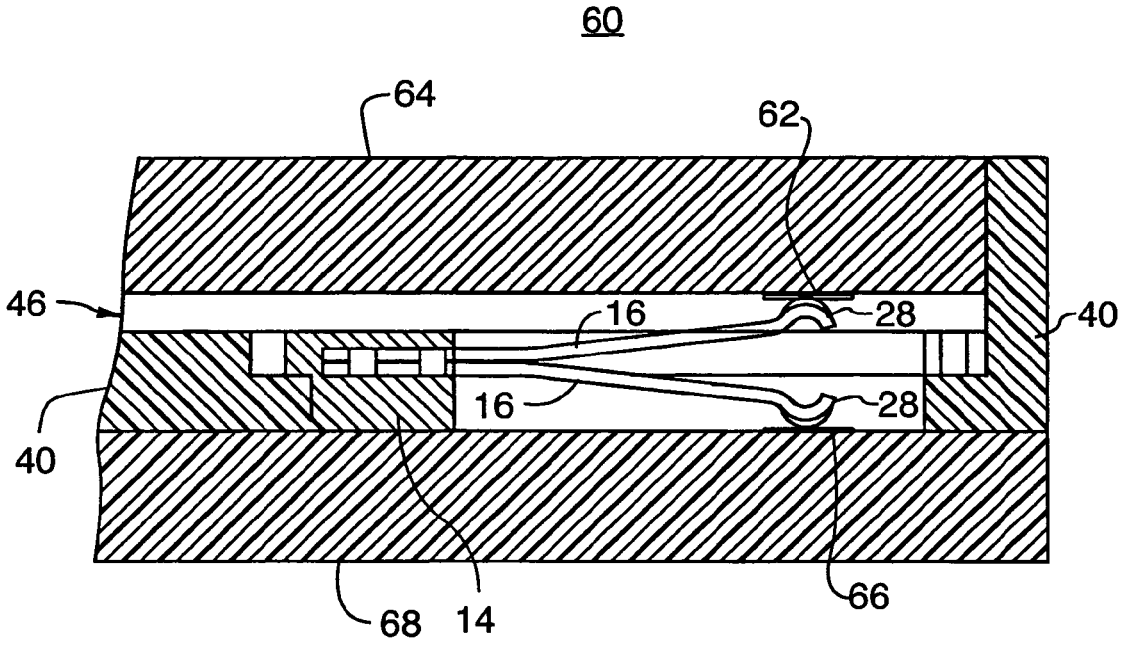
FIG. 11 is a cross-section of the connector assembly within the frame in an assembly with a first and second structure.

FIG. 11 is a cross-section of an apparatus 60 to connect contact pads 62 on a first structure 64 with contact pads 66 on a second structure 68 with the connector assembly 10 mounted within the frame 40. When the connector assembly body 14 is mounted within the frame 40, the connectors 16 of the connector assembly extend outwardly from the frame 40 such that the contact areas 28 of the connectors 16 engage the contact pads 62 of the first structure 64 the contact pads 66 of the second structure 68. The frame 40 aligns the first structure 64 and second structure 68 so that their respective contact pads 62, 66 are aligned with the connector contact areas 28. The frame may have cushioning 46 between the first structure 64 and the frame 40 to cushion the first structure 64 from damage when dropped or shaken.

FIG. 12 is an exploded view of an exemplary product assembly 70 for connecting contact pads of an EL panel, attached to an LCD module, to contact pads on a PCB. This product assembly is typically used in mobile electronic devices where space is limited within the device, such as a cellular phone, or a PDA, or other wireless communication devices. The product assembly connects the internal PCB with an LCD module and its EL panel in a configuration to minimize the thickness of the assembly and to minimize movement between the two structures within an electronic device.

An EL panel 80 (shown in FIG. 13 and FIG. 14) is attached to the back of an LCD module 74, which sits within the recess 44 of the frame 40. The frame 40 may sit on the PCB 72 or interlock with the PCB 72 using clamps 48 on the frame 40 that secure the PCB 72 to the frame 40. The LCD module 74 has a circuit on flex 76 (FIG. 14) which has a flex connector 90 that fits through a hole in the frame 40 and connects to a receptacle (not shown) on the PCB 72 to power and drive the LCD module 74. The EL panel 80, attached to the bottom of the LCD module 74, has contact pads 102 (shown in FIGS. 14 and 15), which align with the contact areas 28 of the connectors 16 of the connector assembly 10 at the front side of the frame 40. The remaining connector contact areas 28 align with the contact pads 78 on the PCB 72.

Figure 13:
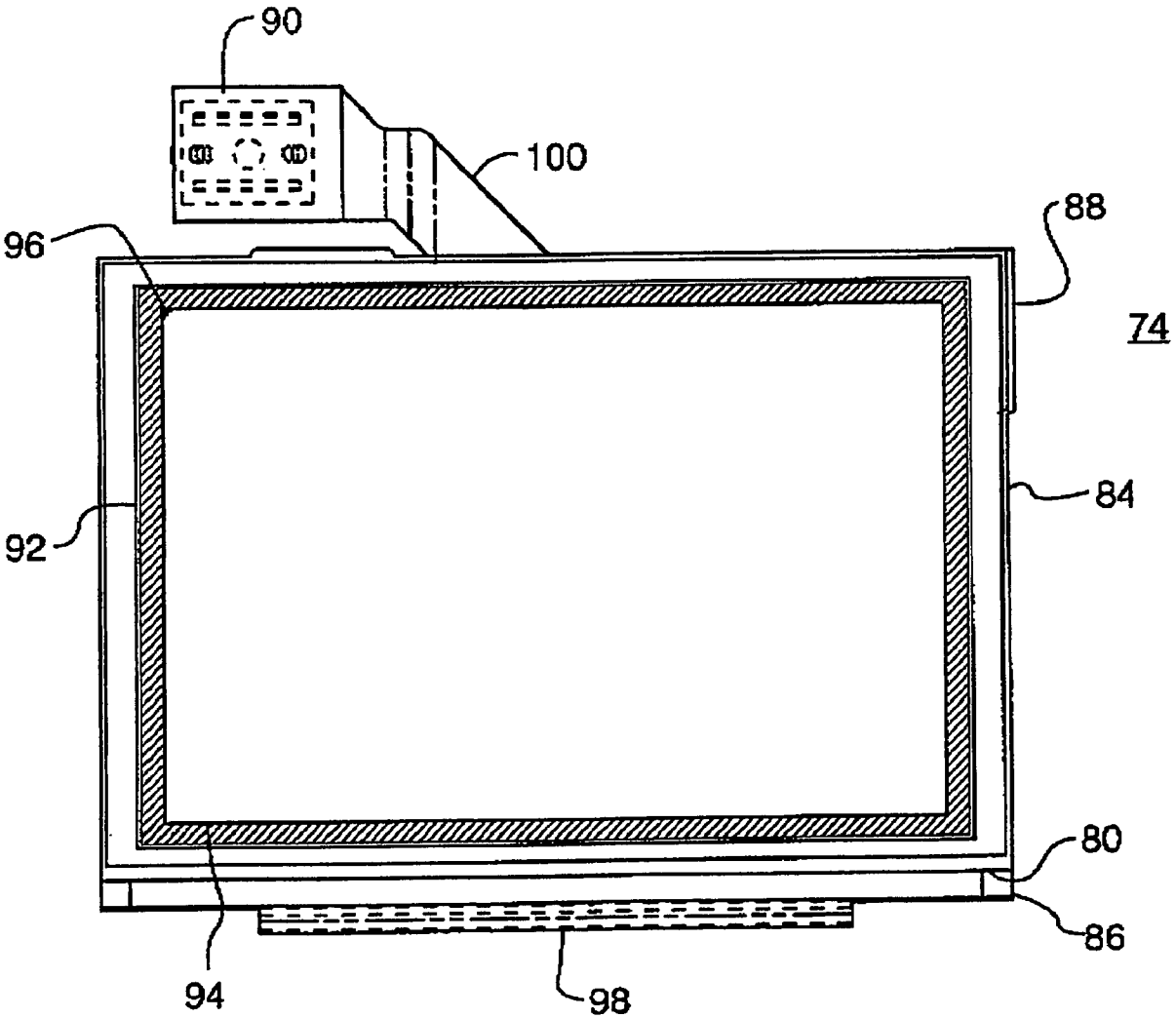
FIG. 13 is a front view of an LCD module.

FIG. 13 is a front view of an LCD module 74 that is used in the apparatus in FIGS. 11 and 12. The LCD module 74 has a top glass 84, a bottom glass 86, a flex circuit 76 (FIG. 13), a flex connector pin 90, and an EL panel contact pad tab 88. The top glass 84 has a viewing area 92 and an active area 94. The viewing area 92 is the entire area of the top glass 84 of the LCD module 74 that is viewable when in use in an electronic device. The active area 94 is the area of the top glass 84 where pixels 96 are driven to form images. The bottom glass 86 or top glass 84 is connected to the flex circuit 76 via a heat-sealed flex connection 98.

Figure 14:
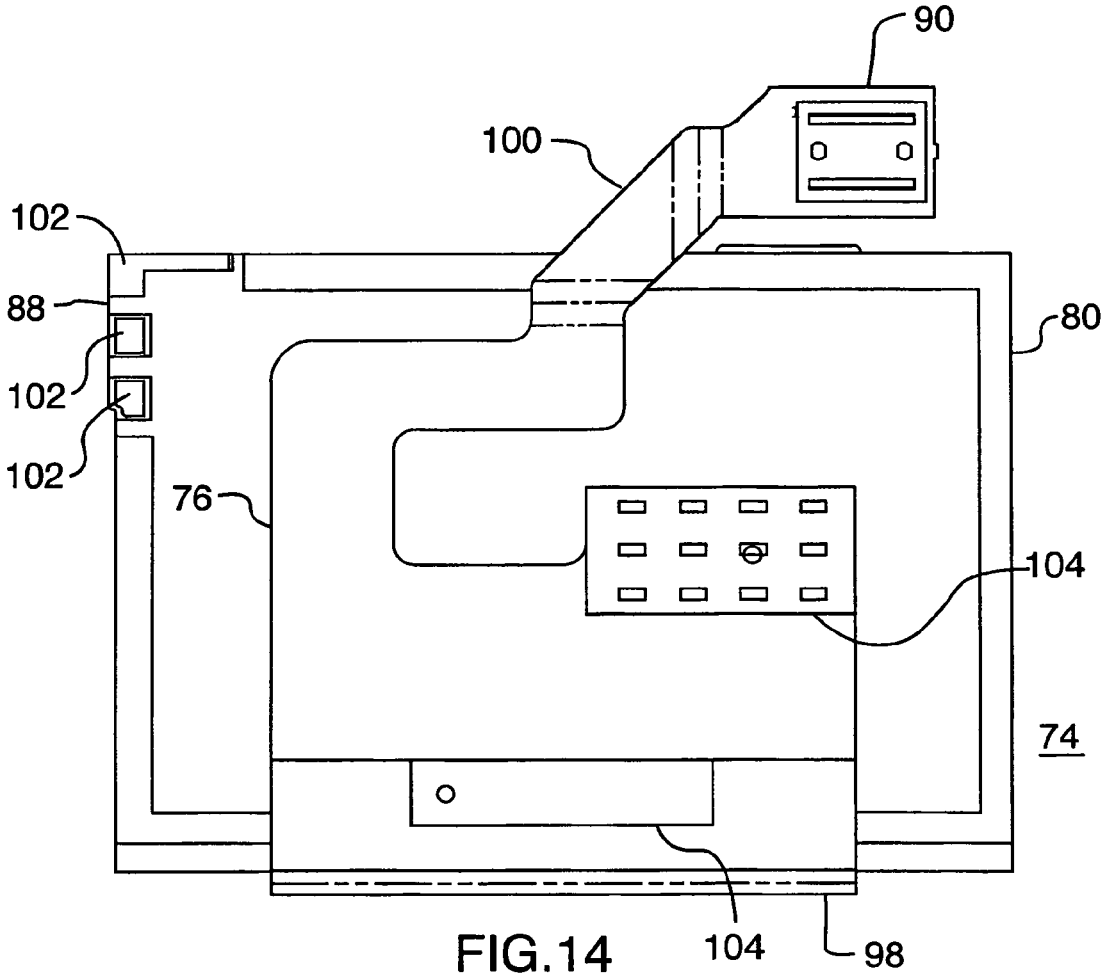
FIG. 14 is a rear view of an LCD module.

FIG. 14 is a view of the back of the LCD module in FIG. 12. The EL panel 80 fits over and is attached to the bottom glass 86 using an adhesive. When the EL panel 80 is activated, the light from the panel 80 shines through the bottom glass 86 of the LCD module to illuminate the viewing area 92. The flex circuit 76 has LCD driver circuitry 104 and a connection 98 to the bottom glass 86 or the top glass 84. A strip of flex material 100 holds the flex connector pin 90 and fits through an appropriate opening within the frame (not shown). The flex connector pin 90 connects the flex circuitry 76 to a receptacle (not shown) on the PCB 72 thereby connecting the LCD driver circuitry 104 to the PCB 72.

The EL panel 80 has contact pads 102 that are electrically connected to the PCB 72 to connect to EL panel driver circuitry (not shown) on the PCB 72. The EL contact pads 102 are printed in layers onto the EL panel 80. The EL contact pads 102 are typically layers of carbon, silver, or a combination of layers of carbon and silver. The electrical connector assembly 10 mounted in the frame 40 engages these contact pads 102 through the connector assembly's contact areas 28 when the LCD module 74 is sitting in the recess 44 of the frame 40. The associated contact pads 78 on the PCB 72 are engaged with the connector assembly's contact areas 28 on the other side of the frame 40, thereby electrically connecting the two contact pads.

FIG. 15 is a detailed drawing of the EL panel contact pads tab 88. The EL panel juts out at the contact pads 102 forming a tab that protrudes from the edge of the LCD module 74 by a distance d. An EL contact pad is formed by printing conductive layers of carbon, silver, or a combination of layers of carbon and silver onto the laminate of the EL panel. EL panel manufacturers have tolerances that will not allow printing these layers to the edge of an EL panel. These tolerances for printing contact pads on an EL panel prevent shorts between the layers of the contact pad and the EL panel. By forming a protruding tab 88, the contact pads can be printed to a "virtual" edge. That is, the tab allows an EL panel manufacturer to print the contact pads on the tab to the manufacturer's allowed tolerance such that if the contact pads had been printed on an EL without a tab, the contact pads would come to the edge of the EL panel. This protruding tab 88 enlarges the surface area of the EL panel contact pads 102 and increases the amount of contact made between the EL panel contact pads 102 with the connector assembly 10 when the LCD module 74 is assembled in the frame 40. This overhang also allows for movement of the LCD module 74 within the frame while the connectors 16 stay contact with the EL panel contact pads 102. Because the LCD module 74 can move with respect to the PCB 72, when the apparatus 70 is assembled, damage to the EL panel 80 is minimized. In the case of soldering the EL contact pads 102 to the PCB contact pads 72, movement between the module 74, and the contact pads 72 may rupture the EL panel 80 or cause broken solder connections.

In other words, the EL panel has a tab portion adjacent its normal edge extending outwardly from that edge by a distance d, where that distance d is sufficient to permit placement of one or more electrical contact pads with the contact pad outer edge(s) generally aligned with the "normal" edge of the EL panel, i.e. the edge in the area beyond the tab portion.

The example of the connector assembly in FIGS. 1-14 shows a connector assembly with three connectors. However, the connector assembly is not limited to a certain number of connectors. For example, in the case where a connector assembly is required to connect a single contact pad on a first structure to a single pad on a second structure, only one connector is required on the connector assembly. The connector assembly may have one, or more, connectors depending on the number of connections required between the first and second structures.

The connector assemblies of FIGS. 1-14 show a body 14 that fits into an opening in a frame. The body 14 of the connector assembly is not limited to this shape and may have any shape such that the connector assembly 10 is mountable between two opposing structures and such that the connectors 16 extend outwardly to connect contact pads on the two opposing structures. The connector assembly body 14 may also be permanently mounted within a frame as opposed to being removable from a frame.

The above-described embodiments are intended to be examples only. Alterations, modifications and variations may be effected to the particular embodiments by those of skill in the art without departing from the scope of the invention, which is defined solely by the claims appended hereto.

The invention claimed is:

1. An electrical connector assembly for connecting at least one electrical contact pad on a first structure with at least one electrical contact pad on an opposing second structure, in combination with a frame, said connector assembly comprising:

a body having at least one pair of electrical connectors extending therefrom, said body being mountable relative to said first and second structures for said electrical connectors to engage the electrical contact pads on said first and second structures, said at least one pair of electrical connectors being of a springy metal and configured to be biased against said contact pads when said connector assembly is assembled with said first and second structures;

wherein the at least one pair of electrical connectors comprises a single sheet of material having a first and a second arm portion coupled to a common base portion, with the common base portion being split into a first base portion sharing a common first longitudinal axis with and connected to the first arm; and a second base portion sharing a common second longitudinal axis with and connected to the second arm portion, with the first and second base portions being connected to one another by a hinge portion, said hinge portion comprising a folded over section of the common base portion, with the first and second longitudinal axes being positioned in a single common vertically extending plane when viewed from the top of the assembly such that the first base portion is positioned on top of the second base portion and the hinge portion is positioned so that its axis of rotation is parallel to the first and second longitudinal axes, wherein said body is mounted between said first and second structures, and said body is mounted in said frame, said frame having top and bottom sides having means for engaging and aligning said body with said opposing first and second structures, with said first and second structures being positioned one on each side of said frame.

2. An electrical connector assembly as in claim 1, wherein at least one said electrical connector extends outwardly from said top side of said frame and at least one electrical connector extends outwardly from said bottom side of said frame, to contact said electrical contact pads on said opposing structures.

3. An electrical connector assembly as in claim 2, wherein the single sheet of material is a metal spring material, and each arm is bent at an opposite angle relative to the common base portion to provide said biasing against said contact pads, said common base portion being captured in the body by overmolding of said body.

4. A product assembly for connecting electrical contact pads on opposing first and second structures, said product assembly comprising:

a frame having means for engaging and aligning with said first structure on a first side of said frame, and means for engaging and aligning with said second structure on a second side of said frame; and an electrical connector assembly for connecting at least one electrical contact pad on a first structure with at least one electrical contact pad on an opposing second structure, said connector assembly comprising:

a body having at least one pair of electrical connectors extending therefrom, said body being mountable relative to said first and second structures for said electrical connectors to engage the electrical contact pads on said first and second structures, said at least one pair of electrical connectors being of a springy metal and configured to be biased against said contact pads when said connector assembly is assembled with said first and second structures;

wherein the at least one pair of electrical connectors comprises a single sheet of material having a first and a second arm portion coupled to a common base portion, with the common base portion being split into a first base portion sharing a common first longitudinal axis with and connected to the first arm; and a second base portion sharing a common second longitudinal axis with and connected to the second arm portion, with the first and second base portions being connected to one another by a hinge portion, said hinge portion comprising a folded over section of the common base portion, with the first and second longitudinal axes being positioned in a single common vertically extending plane when viewed from the top of the assembly such that the first base portion is positioned on top of the second base portion and the hinge portion is positioned so that its axis of rotation is parallel to the first and second longitudinal axes, said body being mounted in said frame such that the first arm portion contacts the first structure and the second arm portion contacts the second structure.

5. A mobile electronic device, in combination with a frame, comprising a first structure and a second structure, and an electrical connector assembly to connect at least one electrical contact pad on said first structure with at least one electrical contact pad on said second structure, said electrical connector assembly comprising a body having at least one pair of electrical connectors extending therefrom, said body being mountable relative to said first and second structures for said electrical connectors to engage electrical contact pads on said first and second structures, said at least one pair of electrical connectors comprising a longitudinally extending common portion having two arms extending at an angle from said common portion, said common portion comprising a first part connected to the first arm and a second part connected to the second arm, with the first part and first arm sharing a first longitudinal axis and the second part and the second arm sharing a second longitudinal axis, when viewed from the top of the assembly, and with the first and second parts of the common portion being connected by a hinge portion, said hinge portion being a folded over section of the common portion, with said at least one pair of electrical connectors being of a springy metal and configured to be biased against said contact pads when said connector assembly is assembled with said first and second structures;

wherein the longitudinal axis of the first part of the common portion is vertically aligned with the longitudinal axis of the second part of the common portion and the hinge portion is positioned so that its axis of rotation is parallel to the longitudinal axis of the first part and the longitudinal axis of the second part and said body is mountable between said first and second structures, said body being mounted in said frame, said frame having top and bottom sides having means for engaging and aligning said body with said first and second structures that are positioned one on each side of said frame such that said structures are opposing one another.

6. A mobile electronic device as in claim 5, wherein at least one said electrical connector extends outwardly from said top side of said frame and at least one extends outwardly from said bottom side of said frame, to contact said electrical contact pads on said opposing structures.

7. A mobile electronic device as in claim 6, wherein the at least one pair of electrical connectors are from one piece of a metal spring material and each arm is bent at an opposite angle relative to said common portion to provide said biasing against said contact pads, said common portion being captured in the body by overmolding of said body.

8. A mobile electronic device as in claim 5, wherein said first and second structures are printed circuit boards.

9. A mobile electronic device as in claim 5, wherein said first structure is an electroluminescent panel and said second structure is a printed circuit board.

10. A mobile electronic device as in claim 9, wherein said electroluminescent panel is attached to a liquid crystal display module.

* * * * *